US007108034B2

(12) United States Patent
Andersson

(10) Patent No.: US 7,108,034 B2
(45) Date of Patent: Sep. 19, 2006

(54) DEVICE FOR LABELING

(75) Inventor: Gert Andersson, Askersund (SE)

(73) Assignee: Dahlander Marking AB, (SE)

( * ) Notice: Subject to any disclaimer, the term of this patent is extended or adjusted under 35 U.S.C. 154(b) by 0 days.

(21) Appl. No.: 10/839,061

(22) Filed: May 5, 2004

(65) Prior Publication Data

US 2005/0016688 A1 Jan. 27, 2005

(30) Foreign Application Priority Data

May 6, 2003 (SE) ..... 0301336

(51) Int. Cl.
*B65C 5/00* (2006.01)
*B65C 9/08* (2006.01)

(52) U.S. Cl. ..... 156/387; 156/538; 156/556; 156/DIG. 19; 156/DIG. 28

(58) Field of Classification Search ..... 156/538–542, 156/556, DIG. 37, 39, 42
See application file for complete search history.

(56) References Cited

U.S. PATENT DOCUMENTS 2,103,654 A 12/1937 Weimont et al. ..... 93/88
3,321,105 A * 5/1967 Marano ..... 221/22
3,428,509 A * 2/1969 Messmer ..... 156/361
3,598,025 A 8/1971 Cotton ..... 93/87
4,354,894 A 10/1982 Lewis et al. ..... 156/517
4,985,096 A 1/1991 Bekker-Madsen ..... 156/64
5,658,647 A 8/1997 Magill et al. ..... 428/195
5,674,345 A * 10/1997 Nash ..... 156/264
5,879,507 A * 3/1999 Schroeder et al. ..... 156/542
6,550,512 B1 * 4/2003 Yang ..... 156/351

FOREIGN PATENT DOCUMENTS

DE 2 217 032 10/1973

* cited by examiner

*Primary Examiner*—Melvin Mayes
(74) *Attorney, Agent, or Firm*—Hayes Soloway P.C.

(57) ABSTRACT

Device for the labeling of clothes including a label printer (1) and a fastening station (12), and a device for the transfer of the labels and holding these in position for fixing that includes a guide or slide plane next to which the printer is arranged so that the labels are ejected along the guide or plane. The guide is slightly curved in the label feed out direction. An endless belt is arranged above the guide in the label feed direction so that it can press the labels against the guide bringing the labels along to the fastening station (12). The label guide has essentially the same width as the labels and U-shaped upfolded and infolded edges for the guiding the labels.

8 Claims, 1 Drawing Sheet

DEVICE FOR LABELING

BACKGROUND OF THE INVENTION

At the selling of clothes it is in general necessary to provide these with labels indicating size, price etc. Since the indications of size as well as in particular the prize may vary from country to country and from vending place to vending place it is in reality frequently necessary for the selling shop or wholesaler to provide each article of clothing with a label. It is at this known to print labels with computer controlled printers, which labels then more or less manually are applied to the garments in question. For this different types of fastening machines are used, that may be constituted by electric staplers with steel staples or machines that use plastic fixings. Despite fastening and printing of the labels being supported by machinery this labeling or marking of clothes is comparatively time consuming and thereby costly. Furthermore it is a type of work that easily result in wear injuries since it is very repetitive and it may be the same person that for long times stands and do this work.

In view of the above problems the object of the invention is to facilitate the labeling of clothes.

SUMMARY OF THE INVENTION

In accordance with the invention this object is solved by means of a device including a printer and a fastening device, and between the printer and the fastening means a transfer device is placed, which includes a guide next to which the printer is so arranged that the labels are pushed out along the guide by the printer. The guide is in the direction of the ejection slightly bent, an endless rubber tape or string is arranged above the guide in the feed direction of the labels so that it can press the labels against the guide for feeding the labels along to a fastening station for the labels, where the fastening device is located for the fastening of the labels.

BRIEF DESCRIPTION OF THE DRAWINGS

Further advantageous embodiments and characteristics of the invention are apparent from the subclaims and a description of a preferred embodiment described below with reference to the enclosed drawing. In the drawing

DETAILED DESCRIPTION OF PREFERRED EMBODIMENT

Figures 1, 2:
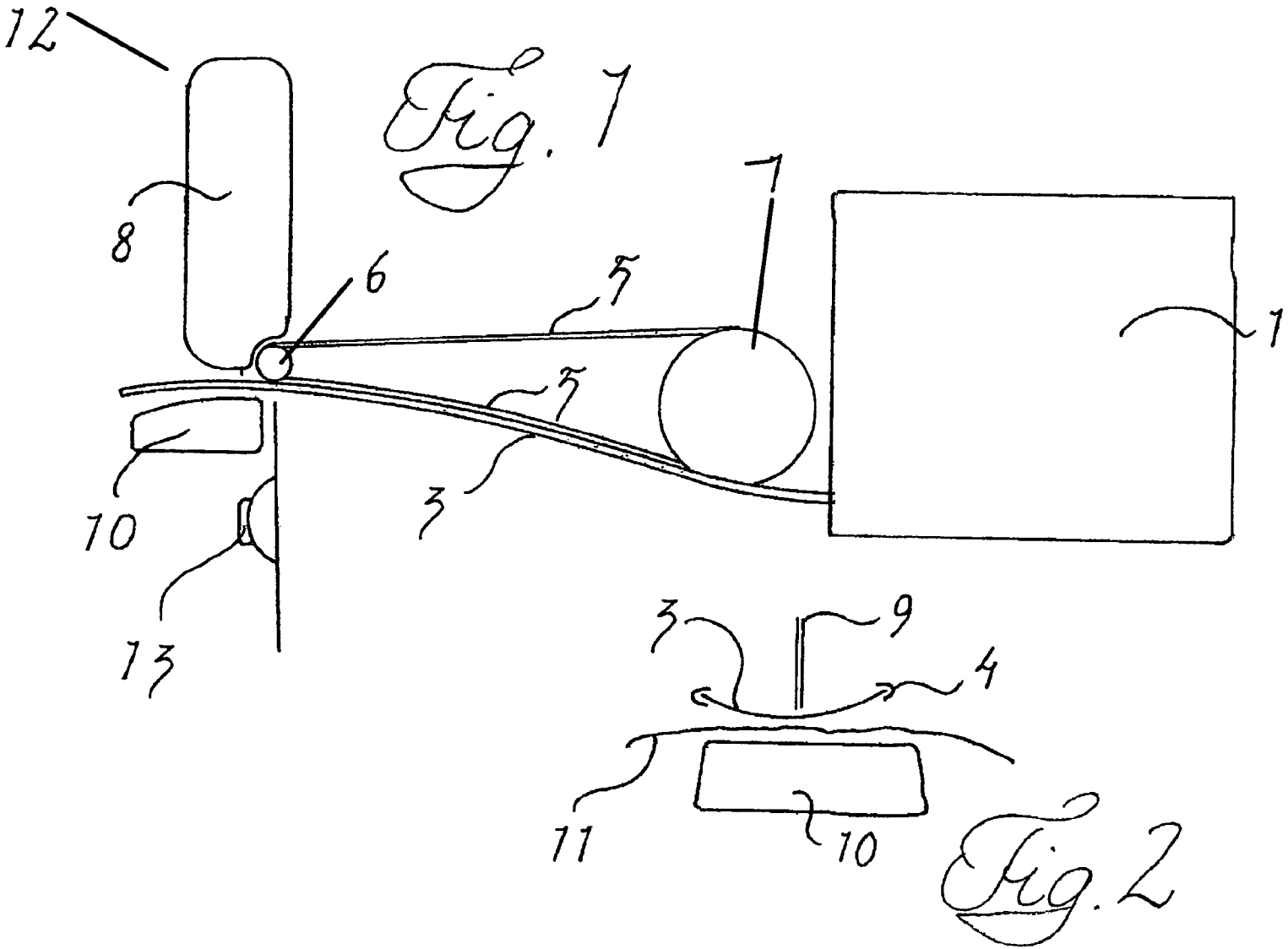
FIG. 1 depicts an embodiment of the invention in a front view and FIG. 2 a detail of the device shown in FIG. 1.

The device shown in the drawing in accordance with the invention includes a printer 1 that prints and feeds out labels cut from a tape. The successively printed labels are fed along an upwards convexly arched guide 3 with a width slightly larger than the label width and that at the edges is folded up and so that the edges are enclosed U-shaped 4 thereby positively guiding the labels. The guide can if so is desired be coated with a friction reducing coating on the side facing the labels.

As the labels are fed from the printer these are forwarded along the guide by a motor driven belt or tape 5 on rollers 6, 7 and are pressed against the label guide 3. Since the label guide is arched or convex (upwards) a contact pressure is obtained all the way for the string 5 against the guide securing a good and certain transport of the labels. The roller of the string 5 in the outer end of the guide 3 is small while the roller proximate to the label printer is larger and provided with a drive motor. The guide extends to a fastening station 12 where the labels are fastened to for instance a garment.

The drive motor of the string runs continuously so that immediately as a label is fed from the printer the string grips the label and transports this along the guide. Where the string transporter ends that is below the center of the small roller, the string no longer drives the label forward even if the string continues to run. In order to ensure that the label stops in a precise position precisely at the fastening machine 8 the outer edges 4 of the guide 3 converge somewhat towards each other at the stopping place of the label. Within the concept of the invention also other types of stops or braking can be considered.

The guide at the fastening machine is further provided with an opening in the bottom (FIG. 2) that is longer but more narrow than the label. In this way the fastening machine can reach to fasten the label to a garment 11 that is held located below the label guide on a counterdie 10. The fastening machine has two needles 9 that are extended down through label and garment bringing along T-shaped folded ends of a short plastic thread into the counterdie 10 and are then retraced upward without the T-shaped ends following along. The garment can now be removed together with the label held by the plastic thread. The T-shaped ends of the thread holds the label in its place after the fastening.

By letting the hole in the bottom of the guide and the contact of the string have a slight overlap it is ensured that the label when the edges of the guide converges will buckle downward already before it is hit by the needles 9.

At the side of the die and in level with an inner stop for the garment a push button 13 is arranged with which the person using the device can initiate a work cycle for the fasting of a label.

The device may in a first embodiment be so arranged or programmed that immediately when a label has been fastened the printer prints a new label that by the string immediately is transported out on the guide and placed at the fastening station for fixing to the next garment. This version is particularly suitable when many garments are to be labeled with identically worded labels.

When different labels are to be printed it may be more practical that instead a pushing of the button initiates the printer, feed and finally fastening by means of the fastening device. Also this operation is very fast.

Instead of using a push button for the initiating of the labeling a photo cell or other position sensor may be used.

Since the device in accordance with the invention includes few moving parts and simple movements a very great precision, good safety and long life can be achieved. The safety is further enhanced by the label not having to be held in its location by the person carrying out the work. In this way hands and fingers can be held considerably further away from the fastening station, which considerably increase the safety in the work. Since the moving parts are light the risk of injuries is further reduced.

The invention claimed is:

1. A device for the application of labels to clothes, said device comprising a label printer and a label fastener, and a transfer device located between the label printer and the label fastener, wherein the transfer device includes a guide arranged such that labels from the label printer are fed by a motor driven endless belt arranged above the guide to the label fastener, wherein the label guide has essentially the same width as the labels, and wherein the guide has longitudinal edges which are folded up for guiding the labels.

2. The device according to claim 1, wherein the upfolded edges of the guide are folded inward to enclose the label edges.

3. The device according to claim 1, wherein the guide has an opening in its lower surface large enough to allow a label to be pressed through the opening.

4. The device according to claim 3, wherein the guide narrows at its opening adjacent the label fastener.

5. The device according to claim 4, wherein the belt adjacent the end facing the label fastener is run over a roller smaller than a roller proximate the label printer, so as to allow the belt to come close to the label fastener.

6. The device according to claim 3, wherein the opening is narrower than the labels so that the labels are slightly bent when pressed through the opening.

7. The device according to claim 1, wherein the guide is coated with a low friction coating.

8. The device according to claim 1, wherein the guide is curved in the label feed direction.

* * * * *